US011952696B2

(12) United States Patent
Leung et al.

(10) Patent No.: US 11,952,696 B2
(45) Date of Patent: Apr. 9, 2024

(54) COMBINATION WASHING AND DRYING APPARATUSES INCLUDING COOLED WATER CONDENSERS

(71) Applicant: The Procter & Gamble Company, Cincinnati, OH (US)

(72) Inventors: Benny Leung, Wyoming, OH (US); Howard Jay Kalnitz, Cincinnati, OH (US); Jason Allen Stamper, Covington, KY (US); Carlos Amador Zamarreno, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 862 days.

(21) Appl. No.: 17/024,915

(22) Filed: Sep. 18, 2020

(65) Prior Publication Data

US 2021/0079577 A1 Mar. 18, 2021

(30) Foreign Application Priority Data

Sep. 18, 2019 (EP) ..... 19198046

(51) Int. Cl.
*D06F 58/24* (2006.01)
*D06F 29/00* (2006.01)

(52) U.S. Cl.
CPC ..... *D06F 29/005* (2013.01); *D06F 58/24* (2013.01)

(58) Field of Classification Search
CPC .... D06F 29/005; D06F 58/24; D06F 2105/36; D06F 33/52; D06F 25/00
USPC ..... 34/73, 75
See application file for complete search history.

(56) References Cited

U.S. PATENT DOCUMENTS

| | | | |
|---|---|---|---|
| 9,175,430 | B2 | 11/2015 | Hasanreisoglu et al. |
| 10,011,938 | B2 | 7/2018 | Kim et al. |
| 10,344,417 | B2 | 7/2019 | Kim et al. |
| 11,214,906 | B2 | 1/2022 | Li et al. |

(Continued)

FOREIGN PATENT DOCUMENTS

| | | | |
|---|---|---|---|
| CN | 101480738 | A | 7/2009 |
| CN | 202062118 | U | 12/2011 |

(Continued)

OTHER PUBLICATIONS

International Search Report and Written Opinion; Application Ser. No. PCT/US2020/070529, dated Feb. 3, 2021, 11 pages.

*Primary Examiner* — John P McCormack
(74) *Attorney, Agent, or Firm* — Gary J. Foose

(57) ABSTRACT

An apparatus includes a closed drying air circuit and a drum in communication with the closed drying air circuit. A condenser is in communication with the closed drying air circuit. The condenser includes a cooled water inlet that directs cooled water into the heated air to remove moisture from the heated air. The condenser includes a condenser water outlet for egress of water from the condenser. The cooled water inlet of the condenser is configured to receive water from a tap water source. A thermoelectric apparatus having a cold side flow device arranged between the cooled water inlet of the condenser and the tap water source is included. The cold side flow device is configured to receive tap water from the tap water source and cool the tap water below a tap outlet temperature using the thermoelectric device before the tap water enters the cooled water inlet of the condenser.

13 Claims, 4 Drawing Sheets

(56) References Cited

U.S. PATENT DOCUMENTS

| | | | | |
|---|---|---|---|---|
| 2008/0216517 | A1* | 9/2008 | Chung | D06F 58/46 68/12.02 |
| 2012/0278996 | A1 | 11/2012 | Park et al. | |
| 2013/0008049 | A1* | 1/2013 | Patil | D06F 58/206 34/469 |
| 2016/0230328 | A1 | 8/2016 | Bae et al. | |
| 2021/0095417 | A1* | 4/2021 | Vaive | D06F 49/006 |

FOREIGN PATENT DOCUMENTS

| | | | | |
|---|---|---|---|---|
| CN | 103894676 | A | | 7/2014 |
| EP | 0875347 | A2 | | 11/1998 |
| EP | 2372012 | B1 | | 8/2016 |
| EP | 3192912 | A1 | | 7/2017 |
| EP | 3241944 | A1 | | 11/2017 |
| EP | 3192913 | B1 | | 8/2019 |
| EP | 3502344 | A4 | | 3/2020 |
| JP | H04152970 | A | | 5/1992 |
| JP | H1038431 | A | | 2/1998 |
| JP | 2008136848 | A | | 6/2008 |
| JP | 2013188332 | A | | 9/2013 |
| JP | 2014113190 | A | * | 6/2014 |
| JP | 2014113190 | A | | 6/2014 |
| JP | 2015160415 | A | | 9/2015 |

* cited by examiner

COMBINATION WASHING AND DRYING APPARATUSES INCLUDING COOLED WATER CONDENSERS

FIELD

The present application relates to combination washing and drying apparatuses and, in particular, combination washing and drying apparatuses that include a thermoelectric device that cools tap water for a cooled water condenser.

BACKGROUND

Combination washing and drying apparatuses include both a washing cycle for washing clothes and a drying cycle for drying clothes. For the washing cycle, many of the washing and drying apparatuses have washing cycles that are open in that water that is used to wash the clothes is removed from the washing and drying apparatuses by directing the water to a drain. For the drying cycle, the washing and drying apparatuses may be either vented (i.e., open) or condensing (i.e., closed). In the case of a vented washing and drying apparatus, the wet air from a drum where the clothes are located is directed to the environment. In the case of a condensing washing and drying apparatus, the wet air from the drum is directed to a condenser where moisture is removed from the wet air. The dry air is then directed from the condenser back to the drum for the drying operation.

Energy consumption is an increasingly important factor in washing and drying apparatus design. If clothes can be dried in less time compared to conventional washing and drying apparatuses, then a running time of the washing and drying apparatuses may be reduced. This reduction in running time of the washing and drying apparatuses can result in an energy savings. Accordingly, a need exists for a washing and drying apparatus that includes a cooled water condenser, which can result in more efficiently removing water from the wet air leaving the drum during a drying cycle.

SUMMARY

In an embodiment, an apparatus includes a closed drying air circuit and a drum in communication with the closed drying air circuit. A condenser is in communication with the closed drying air circuit and located downstream of the drum. The condenser includes a cooled water inlet that directs cooled water into the heated air to remove moisture from the heated air.

The condenser includes a condenser water outlet for egress of water from the condenser. The cooled water inlet of the condenser is configured to receive water from a tap water source. A thermoelectric apparatus includes a thermoelectric device. The thermoelectric apparatus includes a cold side flow device arranged between the cooled water inlet of the condenser and the tap water source. The cold side flow device is configured to receive tap water from the tap water source and cool the tap water below a tap outlet temperature using the thermoelectric device before the tap water enters the cooled water inlet of the condenser.

In another embodiment, an apparatus includes a closed drying air circuit and a drum in communication with the closed drying air circuit. A condenser is in communication with the closed drying air circuit and located downstream of the drum. The condenser includes a cooled water inlet that directs cooled water into the heated air to remove moisture from the heated air. The condenser includes a condenser water outlet for egress of water from the condenser. The cooled water inlet of the condenser is configured to receive water from a tap water source. A thermoelectric apparatus includes a thermoelectric device. The thermoelectric apparatus includes a cold side flow device arranged between the cooled water inlet of the condenser and the tap water source. The cold side flow device configured to cool the tap water to no greater than about 9° C. using the thermoelectric device before the tap water enters the cooled water inlet of the condenser.

In another embodiment, a method of removing water from heated air of an apparatus comprising a closed drying air circuit is provided. The method includes directing heated air from a drum to a condenser through the closed air drying circuit. The condenser includes a cooled water inlet that provides cooled water to remove moisture from the heated air. Tap water is directed from a tap water source to a thermoelectric apparatus including a thermoelectric device.

The thermoelectric apparatus includes a cold side flow device arranged between the cooled water inlet of the condenser and the tap water source. The tap water is cooled below a tap outlet temperature using the thermoelectric device before the tap water enters the cooled water inlet of the condenser.

BRIEF DESCRIPTION OF THE DRAWINGS

While the specification concludes with claims particularly pointing out and distinctly claiming the present invention, it is believed the same will be better understood from the following description taken in conjunction with the accompanying drawing in which:

DETAILED DESCRIPTION

Figure 1:
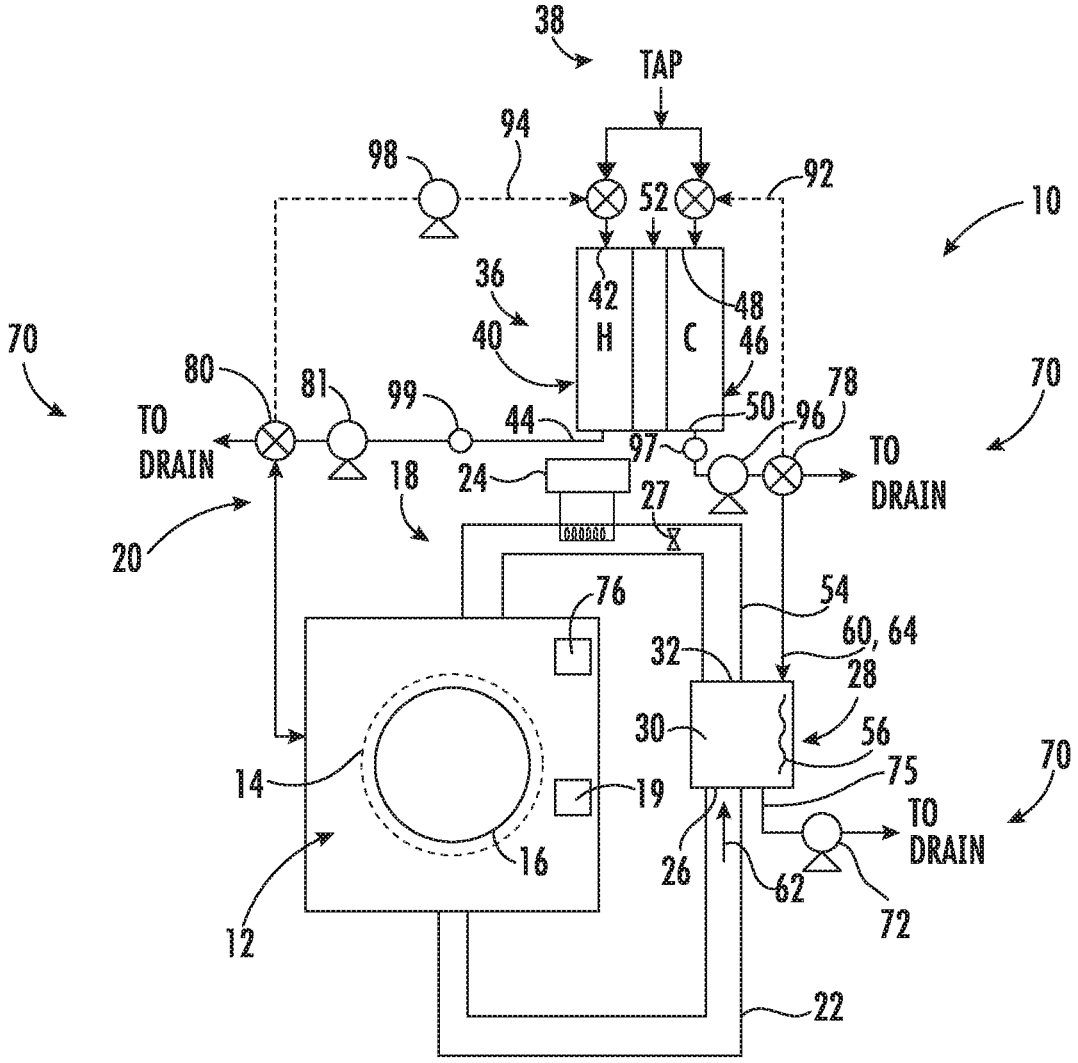
FIG. 1 is a schematic view of a washing and drying apparatus including a thermoelectric apparatus, according to one or more embodiments shown and described herein.

Embodiments described herein may be understood more readily by reference to the following detailed description. It is to be understood that the scope of the claims is not limited to the specific compositions, methods, conditions, devices, or parameters described herein, and that the terminology used herein is not intended to be limiting. Also, as used in the specification, including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent basis "about," it will be understood that the particular values form another embodiment. All ranges are inclusive and combinable.

Embodiments described herein are generally directed to a washing and drying apparatus that includes a closed drying air circuit for use during a drying cycle and a wash water circuit for use in a washing cycle. The washing and drying apparatus includes a drum that is in communication with both the drying air circuit and the washing water circuit. A condenser is in communication with the closed drying air circuit and is located downstream of the drum for receiving heated wet air (i.e., high humidity) from the drum during the drying cycle. The condenser has a water inlet that directs cooled water into the heated air for removing moisture from the heated wet air through the process of condensation. Due to a temperature difference between the cooled water and condenser and the heated wet air, the heated wet air reaches a dew point where water condenses into a liquid state and is removed from the heated air.

A thermoelectric apparatus is provided between the condenser and a tap water source. The thermoelectric apparatus includes a hot side flow device that includes a hot side water input and a hot side water output. In some embodiments, the hot side flow device may not have a hot side water input nor hot side water output and may be air cooled. The thermoelectric apparatus further includes a cold side flow device that includes a cold side water input and a cold side water output. A thermoelectric device is located between the hot side flow device and the cold side flow device. A "thermoelectric device" refers to a device that uses the Peltier effect to create a heat flux at the junction of two different types of materials. The thermoelectric device is a solid-state active heat pump that transfers heat from one side of the device to the other using electrical energy. As will be described in greater detail herein, the thermoelectric apparatus cools the tap water below an initial tap water outlet temperature (i.e., the temperature of the tap water as the tap water leaves a spigot or faucet) to a temperature below that of the tap water outlet temperature before the tap water enters the condenser.

Referring to FIG. 1, a washing and drying apparatus 10 is illustrated diagrammatically and includes a housing 12, a tub 14 located in the housing and a drum 16 that is located inside the tub 14. A motor 19 is located inside the housing 12 and is used to rotate the drum 16. The washing and drying apparatus 10 includes a closed drying air circuit, generally referenced as element 18, and a wash water circuit, generally referenced as element 20. While components of the closed drying air circuit 18 and the wash water circuit 20 are illustrated outside the housing 12, this is merely for illustration as the closed drying air circuit 18 and wash water circuit 20 are located inside the housing 12.

The closed drying air circuit 18 includes an air circulation duct 22 that is fluidly connected to the drum 16. The air circulation duct 22 is fluidly connected to the drum 16 for delivering air that is heated by heater 24 to a heated temperature to the drum 16 during a drying cycle. A fan 27 may be provided to encourage air circulation through the air circulation duct 22 to and from the drum 16.

Once the heated air is cycled through the drum 16, the heated wet air is delivered through the circulation duct 22 to an air inlet 26 of a condenser 28. The condenser 28 includes a condensing apparatus 30 (e.g., a tube, etc.) that is fluidly connected to the circulation duct 22 at both the air inlet 26 and an air outlet 32. The condenser 28 is configured to remove moisture from the heated wet air and through the process of condensation before the air is reheated and delivered back to the drum 16 with reduced relative humidity after heating back to about the same (e.g., ±5° C.) heated temperature.

A thermoelectric apparatus 36 is provided between the condenser 28 and a tap water source 38. The thermoelectric apparatus 36 includes a hot side flow device 40 that includes a hot side water input 42 and a hot side water output 44. The thermoelectric apparatus 36 further includes a cold side flow device 46 that includes a cold side water input 48 and a cold side water output 50. The hot side flow device 40 and the cold side flow device 46 each contain a duct that extends between the inputs 42, 48 and outputs 44, 50 that can be any suitable shape, such as curved, undulating, straight, etc. that allows for heating and cooling of the tap water therethrough. Located between the hot side flow device 40 and the cold side flow device 46 is a thermoelectric device 52. The thermoelectric device 52 may be connected to the hot side flow device 40 and the cold side flow device 46 using any suitable process, such as a thermal adhesive. The thermoelectric device 52 transfers heat from tap water flow through the cold side flow device 46 to tap water flowing through the hot side flow device 40 thereby cooling the tap water from an initial tap outlet temperature to a cooled water temperature.

The tap outlet temperature can depend on several factors, such as seasons, environmental temperature, time of day, region of the world, etc. For example, temperature of the tap water may be between about 50° C. and 7° C. The thermoelectric apparatus 36 reduces the tap outlet temperature to the cooled water temperature before the tap water is introduced to the condenser 28. For example, the cooled water temperature may be no greater than about 9° C., such as no greater than about 8° C., such as no greater than about 7° C., such as no greater than about 6° C., such as no greater than about 5° C., such as no greater than about 4° C., such as no greater than about 3° C., such as no greater than about 2° C., such as no greater than about 1° C., such as between about 0° C. and about 9° C., such as between about 0° C. and about 5° C., such as between about 0° C. and about 3° C.

The cooled water is delivered along line 54 to the condenser 28. At the condenser, the cooled water 56 is released into the condenser 28 at a rate of between about 1 g/s and about 16 g/s. In one embodiment, the cooled water 56 is released from a cooled water inlet 60 along an inner surface of a wall 58 of the condensing apparatus 30, which cool the wall 58 to a temperature below that of the heated wet air 62 entering the condenser.

In some embodiments, the cooled water inlet 60 may include a nozzle 64 having a reduced inner diameter compared to the line 54 to generate a spray of small cooled water droplets. The droplet size may be large enough that the water droplets do not become entrained in the heated wet air 62 and to increase the heat transfer coefficient and/or the heat transfer area of the cooled water droplets. As one example, for an air flow of greater than about 4 m/s through the condensing tube 30, a droplet size of greater than about 1076 μm from the nozzle 64 may be used. Generating water droplets of at least about 1076 μm will allow the water droplets to fall through the heated wet air while removing water therefrom. In other embodiments, the cooled water inlet 60 may provide the water as a continuous stream. A pump upstream of the nozzle may be used to generate adequate hydraulic pressure necessary for atomization of the water. Water that is removed from the air and also provided to the condenser 28 through the line 54 is directed to a drain, represented by element 70. A pump 72 may be provided at a condenser water outlet 75 to pump the water from the condenser 28.

The washing and drying apparatus 10 may include a controller 76. The controller 76 may include processing circuitry and a memory that includes logic in the form of machine-readable instructions that is used to control operation of the one or more valves and pumps during the washing and drying cycles. For example, during a washing cycle, the logic may cause the processing circuitry to direct cooled water from the cold side flow device 46 to the drain 70 using valve 78 (e.g., a 3-way valve) that is communicatively coupled to the controller 76. The heated water from the hot side flow device 40 may be directed to the tub 14 using valve 80 and pump 81 that are communicatively coupled to the controller 76. During a drying cycle, the logic may cause the processing circuitry to direct heated water from the hot side flow device 40 to the drain 70 using valve 80. The cooled water from the cold side flow device 46 may be directed to the condenser 28 using the valve 78.

Referring still to FIG. 1, another embodiment of a washing and drying apparatus is illustrated as a variation of the washing drying apparatus 10. In this embodiment, a cooled water recirculation loop 92 and a heated water recirculation loop 94 are provided. When desired, the controller 76 may use the valves 78 and 80 and pumps 96 and 81 to direct the already cooled and already heated water back through the thermoelectric apparatus 36 for additional cooling and heating. In some embodiments, temperature sensors 97 and 99 may be used to provide temperature information that is used by the controller 76 in determining whether or not to direct the water back through the recirculation loops 92 and 94.

Figure 2:
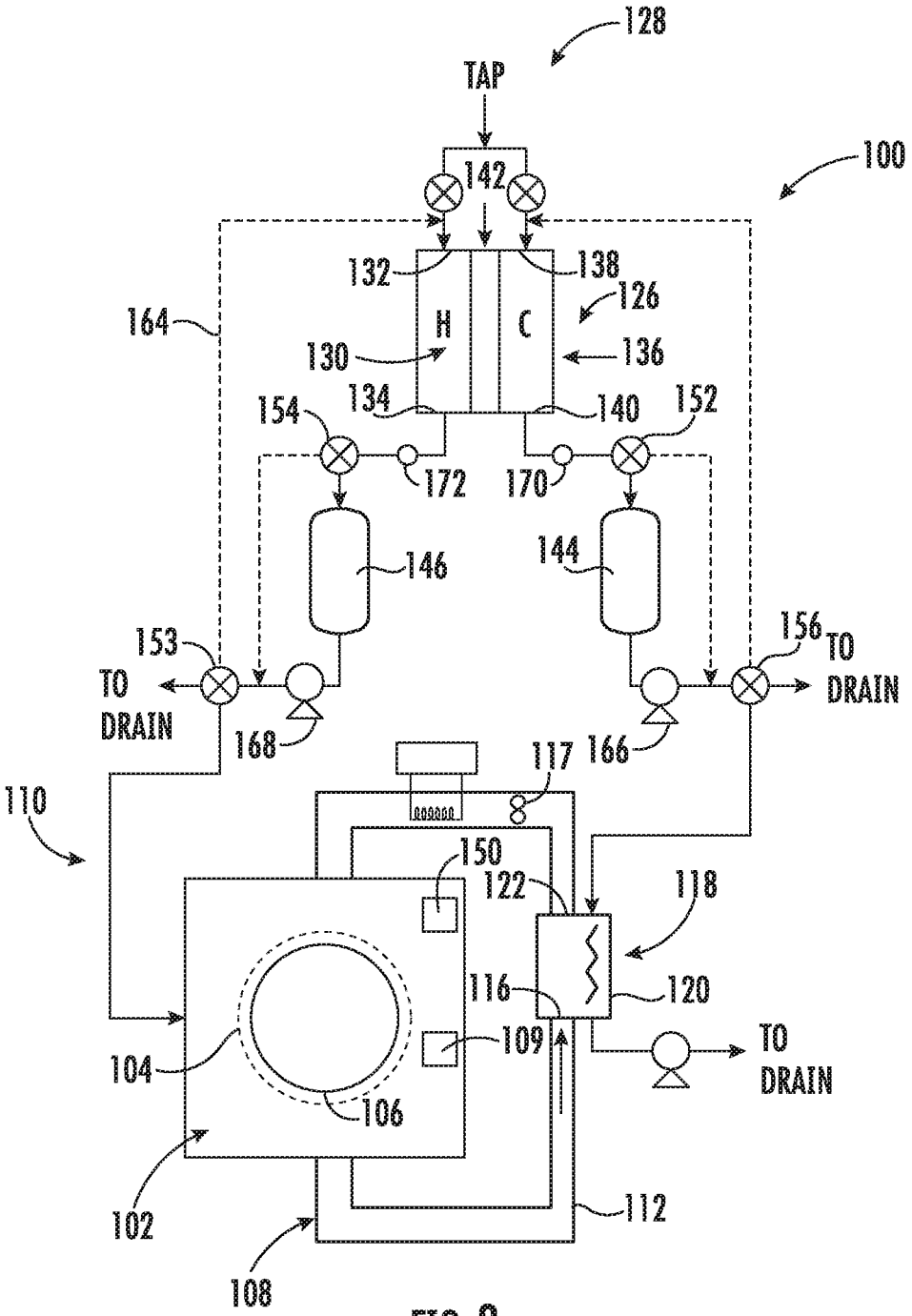
FIG. 2 is a schematic view of another embodiment of a washing and drying apparatus including a thermoelectric apparatus, according to one or more embodiments shown and described herein.

Referring to FIG. 2, another embodiment of a washing and drying apparatus 100 includes many of the features discussed above, such as a housing 102, a tub 104, a drum 106, a motor 109, a closed drying air circuit 108 and a wash water circuit 110. As above, the closed drying air circuit 108 includes an air circulation duct 112 that is fluidly connected to the drum 106 during a drying cycle. A fan 117 may be provided to push air circulation through the air circulation duct 112 to and from the drum 106.

Once the heated air is cycled through the drum 106, the heated wet air is delivered through the circulation duct 112 to an air inlet 116 of a condenser 118. The condenser 118 includes a condensing tube 120 that is fluidly connected to the circulation duct 112 at both the air inlet 116 and an air outlet 122. As above, the condenser 118 is configured to remove moisture from the heated wet air through condensation before the air is reheated and delivered back to the drum 106 with reduced relative humidity after heating back to about the same heated temperature.

A thermoelectric apparatus 126 is provided between the condenser 118 and a tap water source 128. The thermoelectric apparatus 126 includes a hot side flow device 130 that includes a hot side water input 132 and a hot side water output 134. The thermoelectric apparatus 126 further includes a cold side flow device 136 that includes a cold side water input 138 and a cold side water output 140. Located between the hot side flow device 130 and the cold side flow device 136 is a thermoelectric device 142.

Unlike the washing and drying apparatus 10, the washing and drying apparatus 100 includes a cooled water storage 144 and a heated water storage 146. The cooled water storage 144 can receive cooled water from the thermoelectric apparatus 126 after the tap water is cooled to a preselected temperature. Likewise, the heated water storage 146 can receive heated water from the thermoelectric apparatus 126 after the tap water is heated to a preselected temperature. The cooled water storage 144 and the heated water storage 146 may be insulated and each may be temperature controlled to either further cool or heat the water stored therein for a drying cycle or a cooling cycle. In other embodiments, the washing and drying apparatus may include only one of the heated water storage 146 and the cooled water storage 144. In some embodiments, the heated water storage 146 may be the tub 104 rather than a separate heated water storage 146.

The washing and drying apparatus 100 may include a controller 150. The controller 150 may include processing circuitry and a memory that includes logic in the form of machine-readable instructions that is used to control operation of the one or more valves and pumps during the washing and drying cycles, as discussed above. For example, during a washing cycle, the logic may cause the processing circuitry to direct cooled water from the cold side flow device 136 to the cooled water storage 144 using valve 152 that is communicatively coupled to the controller 150. The heated water from the hot side flow device 130 may be directed to the tub 104 using valve 154 that is communicatively coupled to the controller 150. In some embodiments, the heated water from the hot side flow device 130 may bypass or flow through the heated water storage 146 and delivered to the tub 104. In some embodiments, the heated water stored in the heated water storage 146 may be directed to the tub 104 using valve 153. During a drying cycle, the logic may cause the processing circuitry to direct heated water from the hot side flow device 40 to the heated water storage 146 using valve 154. The cooled water from the cold side flow device 136 may be directed to the condenser 118 using the valve 156. In some embodiments, the cooled water from the cold side flow device 136 may bypass or flow through the cooled water storage 144 and delivered to the condenser 118. In some embodiments, the cooled water stored in the cooled water storage 144 may be directed to the condenser 118.

FIG. 2 illustrates another embodiment of a washing and drying apparatus is a variation of the washing and drying apparatus 100. In this embodiment, a cooled water recirculation loop 162 and a heated water recirculation loop 164 are provided. When desired, the controller 150 may use the valves 153 and 156 and pumps 166 and 168 to direct the already cooled and already heated water back through the thermoelectric apparatus 126 for additional cooling and heating. In some embodiments, temperature sensors 170 and 172 may be used to provide temperature information that is used by the controller 150 in determining whether or not to direct the water back through the recirculation loops 162 and 164.

Figure 3:
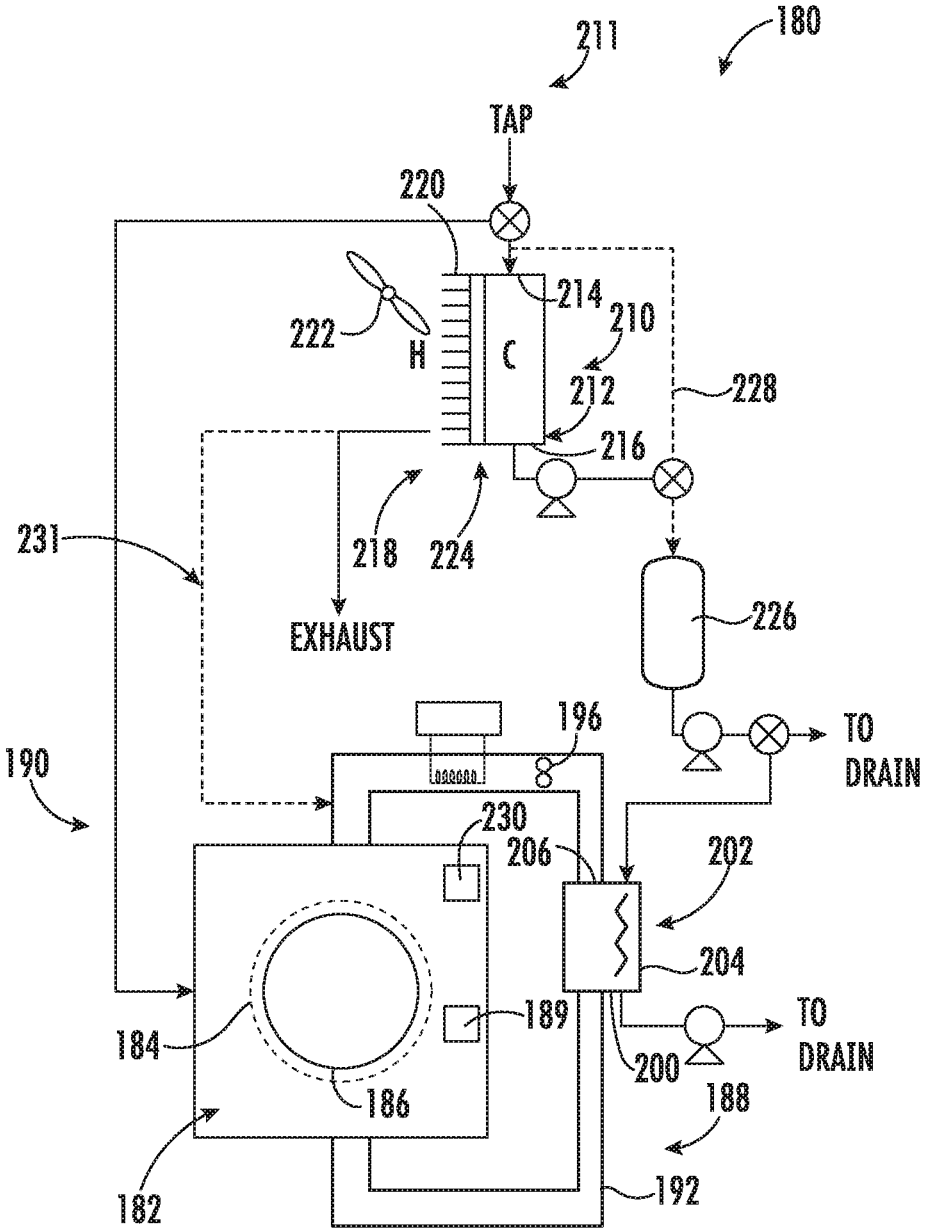
FIG. 3 is a schematic view of another embodiment of a washing and drying apparatus including a thermoelectric apparatus, according to one or more embodiments shown and described herein.

While liquid-to-liquid thermoelectric apparatuses are discussed above, a liquid-to-air thermoelectric apparatus may be used. Referring to FIG. 3, another embodiment of a washing and drying apparatus 180 includes many of the features discussed above, such as a housing 182, a tub 184, a drum 186, a motor 189, a closed drying air circuit 188 and a wash water circuit 190. As above, the closed drying air circuit 188 includes an air circulation duct 192 that is fluidly connected to the drum 186 during a drying cycle. A fan 196 may be provided to push air circulation through the air circulation duct 192 to and from the drum 186.

Once the heated air is cycled through the drum 186, the heated wet air is delivered through the circulation duct 192 to an air inlet 200 of a condenser 202. The condenser 202 includes a condensing tube 204 that is fluidly connected to the circulation duct 192 at both the air inlet 200 and an air outlet 206. As above, the condenser 202 is configured to remove heat from the heated wet air and increase the relative humidity of the heated wet air before the air is reheated and delivered back to the drum 186 with reduced relative humidity after heating back to about the same heated temperature.

A thermoelectric apparatus 210 is provided between the condenser 202 and a tap water source 211. The thermoelectric apparatus 210 includes a cold side flow device 212 that includes a cold side water input 214 and a cold side water output 216. The thermoelectric apparatus 210 further includes a hot side air flow device 218 that includes a plurality of fins 220. A fan 222 may push air over the fins 220 to remove heat therefrom. The heated air may then be vented to the surroundings. Located between the cold side flow device 212 and the hot side air flow device 218 is a thermoelectric device 224. The washing and drying apparatus 180 may further include a cooled water storage 226, a recirculation loop 228 and a controller 230 similar to those described above. FIG. 3 also shows a variation where heated air from the thermoelectric apparatus 210 is directed through line 231 to the closed drying air circuit 188. In some embodiments, there may not be a cooled water storage and cooled water may be sent directly to the condenser 202.

Figure 4:
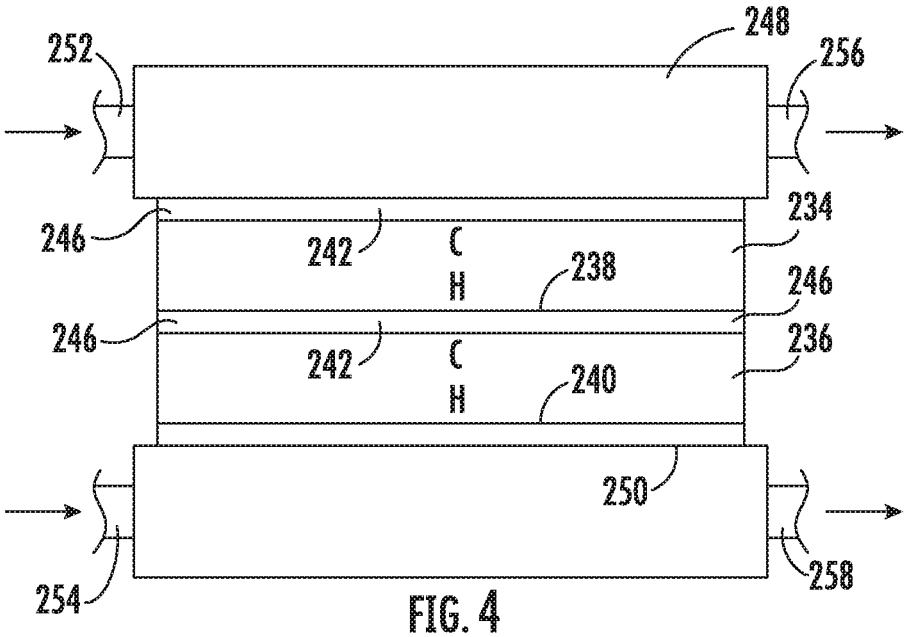
FIG. 4 is a schematic view of a thermoelectric apparatus with multiple thermoelectric devices in series, according to one or more embodiments shown and described herein.

While a single thermoelectric device is discussed above for the thermoelectric apparatuses, there may be multiple thermoelectric devices, such as in series or in parallel. FIG. 4 shows an example of two thermoelectric devices 234 and 236 in series. Each thermoelectric device 234 and 236 has a hot side 238, 240 and a cold side 242, 244. The thermoelectric devices 234 and 236 are connected together by a thermally conductive adhesive 246 or other material, such as a thermally conductive grease. The thermoelectric devices 234 and 236 are sandwiched between a cold side flow device 248 and a hot side flow device 250 with tap water inlets 252, 254 and outlets 256 and 258.

Figure 5:
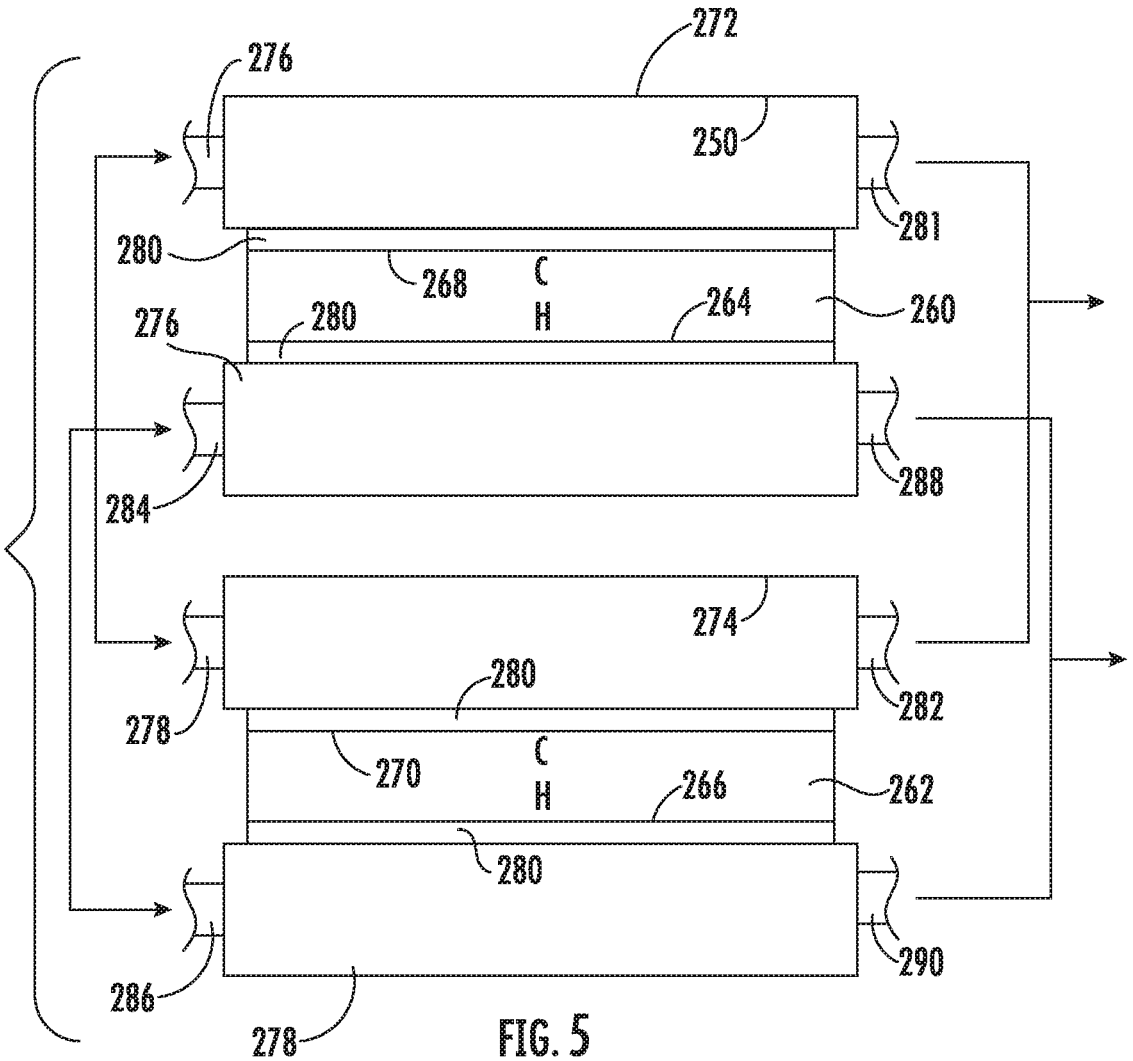
FIG. 5 is a schematic view of a thermoelectric apparatus with multiple thermoelectric devices in parallel, according to one or more embodiments shown and described herein.

FIG. 5 shows an example of two thermoelectric devices 260 and 262 in parallel. Each thermoelectric device 260 and 262 has a hot side 264, 266 and a cold side 268, 270. The thermoelectric devices 260 and 262 are sandwiched between a cold side flow device 272, 274 and a hot side flow device 276, 278 with a thermally conductive adhesive 280 located therebetween. The cold side flow devices 272, 274 include tap water inlets 276, 278 and outlets 281, 282 and the hot side flow devices 276, 278 include tap water inlets 284, 286 and outlets 288, 290. The cooled and heated tap water may exit the outlets 281, 282, 288 and 290 and the cooled tap water from outlets 281, 282 may be combined and the heated tap water from outlets 288, 290 may be combined.

Clause 1: An apparatus comprising a closed drying air circuit, the apparatus comprising: a drum in communication with the closed drying air circuit; a condenser in communication with the closed drying air circuit and located downstream of the drum, the condenser comprising a cooled water inlet that directs cooled water into the heated air to remove moisture from the heated air, the condenser comprising a condenser water outlet for egress of water from the condenser, the cooled water inlet of the condenser configured to receive water from a tap water source; and a thermoelectric apparatus comprising a thermoelectric device, the thermoelectric apparatus comprising a cold side flow device arranged between the cooled water inlet of the condenser and the tap water source, the cold side flow device configured to receive tap water from the tap water source and cool the tap water below a tap outlet temperature using the thermoelectric device before the tap water enters the cooled water inlet of the condenser.

Clause 2: The apparatus of clause 1, wherein a nozzle in the condenser is configured to spray the cooled water droplets into the heated air.

Clause 3: The apparatus of clause 1 or 2, wherein a cold side of the thermoelectric device cools the tap water to no greater than about 9° C.

Clause 4: The apparatus of any one of clauses 1-3, wherein a cold side of the thermoelectric device cools the tap water to no greater than about 5° C.

Clause 5: The apparatus of any one of clauses 1-4, wherein the thermoelectric apparatus comprises a hot side flow device configured to receive tap water from the tap water source for transferring heat away from the cold side flow device.

Clause 6: The apparatus of clause 5 further comprising a cooled water recirculation loop that directs at least some of the cooled water leaving the cold side flow device back to the cold side flow device to reintroduce the cooled water to the cold side flow device.

Clause 7: The apparatus of clause 5 or 6, wherein the thermoelectric apparatus comprises multiple thermoelectric devices.

Clause 8: The apparatus of any one of clauses 5-7 further comprising a wash water circuit in communication with the drum, the apparatus having a washing cycle where wash water is provided to the drum and a drying cycle where hot air is provided to the drum.

Clause 9: The apparatus of clause 8 further comprising a heated water recirculation loop that directs at least some of the heated water leaving the hot side flow device back to the hot side flow device to reintroduce the heated water to the hot side flow device.

Clause 10: The apparatus of clause 8 or 9, wherein heated water from the hot side flow device is directed to a drain during the drying cycle.

Clause 11: The apparatus of any one of clauses 8-10 further comprising a memory and processing circuitry coupled to the memory, the memory including logic that, when executed by the processing circuitry, reduces a rate of flow of tap water to the hot side flow device and cold side flow device during the drying cycle using one or more valves.

Clause 12: The apparatus of any one of clauses 8-11 further comprising a cooled water storage between the cold side flow device and the cooled water inlet of the condenser.

Clause 13: The apparatus of clause 12 further comprising a cooled water recirculation loop that delivers at least some of the cooled water from the cooled water storage to the cold side flow device.

Clause 14: The apparatus of clause 13 further comprising a heated water recirculation loop that delivers at least some of the heated water leaving the hot side flow device back to the hot side flow device to reintroduce the heated water to the hot side flow device.

Clause 15: The apparatus of clause 13 further comprising a heated water storage between the hot side flow device and the drum.

Clause 16: The apparatus of clause 15 further comprising a heated water recirculation loop that delivers at least some of the heated water from the heated water storage to the hot side flow device.

Clause 17: The apparatus of clause 15 or 16 further comprising a memory and processing circuitry coupled to the memory, the memory including logic that, when executed by the processing circuitry, directs cooled water from the cold side flow device to the cooled water storage during the washing cycle and directs heated water to the drum using one or more of a valve and a pump.

Clause 18: The apparatus of clause 17, wherein the memory including logic that, when executed by the processing circuitry, directs heated water from the hot side flow device to the heated water storage during the drying cycle and directs cooled water to the condenser using one or more of a valve and a pump.

Clause 19: The apparatus of 18, wherein the heated water storage is a tub that surrounds the drum or is separate from the tub.

Clause 20: The apparatus of clause 8 or 9 further comprising a heated water storage between the hot side flow device and the drum; and a cooled water recirculation loop that directs at least some of the cooled water leaving the cold side flow device back to the cold side flow device to reintroduce the cooled water to the cold side flow device.

Clause 21: The apparatus of clause 1 further comprising a wash water circuit in communication with the drum, the apparatus having a washing cycle where wash water is provided to the drum and a drying cycle where hot air is provided to the drum; wherein the thermoelectric apparatus comprises a hot side flow device configured to receive air for transferring heat away from the cold side flow device.

Clause 22: The apparatus of clause 21 further comprising a cooled water storage between the cold side flow device and the cooled water inlet of the condenser.

Clause 23: The apparatus of clause 22 further comprising a cooled water recirculation loop that delivers at least some of the cooled water from the cooled water storage to the cold side flow device.

Clause 24: The apparatus of any one of clauses 21-23, wherein heated air from the hot side flow device is vented outside the apparatus.

Clause 25: The apparatus of any one of clauses 21-24, wherein heated air from the hot side flow device is delivered to the closed drying air circuit.

Clause 26: An apparatus comprising a closed drying air circuit, the apparatus comprising: a drum in communication with the closed drying air circuit; a condenser in communication with the closed drying air circuit and located downstream of the drum, the condenser comprising a cooled water inlet that directs cooled water into the heated air to remove moisture from the heated air, the condenser comprising a condenser water outlet for egress of water from the condenser, the cooled water inlet of the condenser configured to receive water from a tap water source; and a thermoelectric apparatus comprising a thermoelectric device, the thermoelectric apparatus comprising a cold side flow device arranged between the cooled water inlet of the condenser and the tap water source, the cold side flow device configured to cool the tap water to no greater than about 9° C. using the thermoelectric device before the tap water enters the cooled water inlet of the condenser.

Clause 27: The apparatus of clause 26, wherein a cold side of the thermoelectric device cools the tap water to no greater than about 5° C.

Clause 28: The apparatus of clause 26 or 27, wherein a nozzle in the condenser is configured to spray the cooled water into the heated air.

Clause 29: The apparatus of any one of clauses 26-28, wherein the thermoelectric device comprises a hot side flow device configured to receive tap water from the tap water source for transferring heat away from the cold side flow device.

Clause 30: The apparatus of clause 29 further comprising a cooled water recirculation loop that directs at least some of the cooled water leaving the cold side flow device back to the cold side flow device to reintroduce the cooled water to the cold side flow device.

Clause 31: The apparatus of clause 29 or 30, wherein the thermoelectric apparatus comprises multiple thermoelectric devices.

Clause 32: The apparatus of any one of clauses 29-31 further comprising a wash water circuit in communication with the drum, the apparatus having a washing cycle where wash water is provided to the drum and a drying cycle where hot air is provided to the drum.

Clause 33: The apparatus of clause 32 further comprising a heated water recirculation loop that directs at least some of the heated water leaving the hot side flow device back to the hot side flow device to reintroduce the heated water to the hot side flow device.

Clause 34: The apparatus of clause 32 or 33, wherein heated water from the hot side flow device is directed to a drain during the drying cycle.

Clause 35: The apparatus of any one of clauses 32-34 further comprising a memory and processing circuitry coupled to the memory, the memory including logic that, when executed by the processing circuitry, reduces a rate of flow of tap water to the hot side flow device and cold side flow device using one or more valves.

Clause 36. The apparatus of any one of clauses 32-35 further comprising a cooled water storage between the cold side flow device and the cooled water inlet of the condenser.

Clause 37: The apparatus of clause 36 further comprising a cooled water recirculation loop that delivers at least some of the cooled water from the cooled water storage to the cold side flow device.

Clause 38: The apparatus of clause 37 further comprising a heated water recirculation loop that delivers at least some of the heated water leaving the hot side flow device back to the hot side flow device to reintroduce the heated water to the hot side flow device.

Clause 39: The apparatus of clause 36 further comprising a heated water storage between the hot side flow device and the drum.

Clause 40: The apparatus of clause 39 further comprising a heated water recirculation loop that delivers at least some of the heated water from the heated water storage to the hot side flow device.

Clause 41: The apparatus of clause 39 or 40 further comprising a memory and processing circuitry coupled to the memory, the memory including logic that, when executed by the processing circuitry, directs cooled water from the cold side flow device to the cooled water storage during the washing cycle and directs heated water to the drum using one or more of a valve and pump.

Clause 42: The apparatus of clause 41, wherein the memory including logic that, when executed by the processing circuitry, directs heated water from the hot side flow device to the heated water storage during the drying cycle and directs cooled water to the condenser using one or more of a valve and a pump.

Clause 43: The apparatus of claim 42, wherein the heated water storage is a tub that surrounds the drum or is separate from the tub.

Clause 44: The apparatus of claim 32 further comprising a heated water storage between the hot side flow device and the drum; and a cooled water recirculation loop that directs at least some of the cooled water leaving the cold side flow device back to the cold side flow device to reintroduce the cooled water to the cold side flow device.

Clause 45: The apparatus of claim 26 further comprising a wash water circuit in communication with the drum, the apparatus having a washing cycle where wash water is provided to the drum and a drying cycle where hot air is provided to the drum; wherein the thermoelectric device comprises a hot side flow device configured to receive air for transferring heat away from the cold side flow device.

Clause 46: The apparatus of clause 45 further comprising a cooled water storage between the cold side flow device and the cooled water inlet of the condenser.

Clause 47: The apparatus of clause 45 or 46 further comprising a cooled water recirculation loop that delivers at least some of the cooled water from the cooled water storage to the cold side flow device.

Clause 48: The apparatus of any one of clauses 45-47, wherein heated air from the hot side is vented outside the apparatus.

Clause 49: The apparatus of any one of clauses 45-48, wherein heated air from the hot side is delivered to the closed drying air circuit.

Clause 50: A method of removing water from heated air of an apparatus comprising a closed drying air circuit, the method comprising directing heated air from a drum to a condenser through the closed air drying circuit, the condenser comprising a cooled water inlet that provides cooled water to remove moisture from the heated air; directing tap water from a tap water source to a thermoelectric apparatus comprising a thermoelectric device, the thermoelectric apparatus comprising a cold side flow device arranged between the cooled water inlet of the condenser and the tap water source; and cooling the tap water below a tap outlet temperature using the thermoelectric device before the tap water enters the cooled water inlet of the condenser.

Clause 51: The method of clause 50, wherein a nozzle in the condenser is configured to spray the cooled water into the heated air.

Clause 52: The method of clause 50 or 51 comprising cooling the tap water to no greater than about 9° C. using the thermoelectric device.

Clause 53: The method of clause 50 or 51 comprising cooling the tap water to no greater than about 5° C. using the thermoelectric device.

Clause 54: The method of any one of clauses 50-53, wherein the thermoelectric apparatus comprises a hot side flow device configured to receive tap water from the tap water source for transferring heat away from the cold side flow device.

Clause 55: The method of clause 54 further comprising directing at least some of the cooled water leaving the cold side flow device back to the cold side flow device to reintroduce the cooled water to the cold side flow device using a cooled water recirculation loop.

Clause 56: The method of clause 55 further comprising a wash water circuit in communication with the drum, the apparatus having a washing cycle where wash water is provided to the drum and a drying cycle where hot air is provided to the drum.

Clause 57: The method of clause 56 further comprising directing at least some of the heated water leaving the hot side flow device back to the hot side to reintroduce the heated water to the hot side flow device using a heated water recirculation loop.

Clause 58: The method of clause 56 or 57 further comprising directing heated water from the hot side flow device to a drain during the drying cycle.

Clause 59: The method of any one of clause 56-58 further comprising directing water leaving the condenser to a drain.

Clause 60: The method of any one of clauses 56-59 further comprising a memory and processing circuitry coupled to the memory, the memory including logic that, when executed by the processing circuitry, reduces a rate of flow of tap water to the hot side during the drying cycle and reduces a rate of flow of tap water to the cold side during the washing cycle.

Clause 61: The method of any one of clauses 56-60 further comprising a cooled water storage between the cold side flow device and the cooled water inlet of the condenser.

Clause 62: The method of clause 61 further comprising delivering at least some of the cooled water from the cooled water storage to the cold side flow device using a cooled water recirculation loop.

Clause 63: The method of clause 62 further comprising delivering at least some of the heated water leaving the hot side flow device back to the hot side flow device to reintroduce the heated water to the hot side flow device using a heated water recirculation loop.

Clause 64: The method of clause 62 or 63 further comprising a heated water storage between the hot side flow device and the drum.

Clause 65: The method of clause 64 further comprising delivering at least some of the heated water from the heated water storage to the hot side flow device using a heated water recirculation loop.

Clause 66: The method of clause 64 or 65 further comprising a memory and processing circuitry coupled to the memory, the memory including logic that, when executed by the processing circuitry, directs cooled water from the cold side flow device to the cooled water storage during the washing cycle and directs heated water to the drum using one or more of a valve and a pump.

Clause 67: The method of clause 66, wherein the memory including logic that, when executed by the processing circuitry, directs heated water from the hot side flow device to the heated water storage during the drying cycle and directs cooled water to the condenser using one or more of a valve and a pump.

Clause 68: The method of clause 67, wherein the heated water storage is a tub that surrounds the drum or is separate from the tub.

Clause 69: The method of clause 56 further comprising a heated water storage between the hot side flow device and the drum; and a cooled water recirculation loop that directs at least some of the cooled water leaving the cold side flow device back to the cold side flow device to reintroduce the cooled water to the cold side flow device.

Clause 70: The method of claim 50 further comprising providing wash water to a drum using a wash water circuit, the apparatus having a washing cycle where wash water is provided to the drum and a drying cycle where hot air is provided to the drum; wherein the thermoelectric device comprises a hot side flow device configured to receive air for transferring heat away from the cold side.

Clause 71: The method of clause 70 further comprising a cooled water storage between the cold side flow device and the cooled water inlet of the condenser.

Clause 72: The method of clause 71 further comprising delivering at least some of the cooled water from the cooled water storage to the cold side flow device a cooled water recirculation loop.

Clause 73: The method of any one of clauses 70-72 further comprising venting heated air from the hot side flow device outside the apparatus.

Clause 74: The method of any one of claims 70-73 further comprising delivering heated air from the hot side flow device to the closed drying air circuit.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus (10) comprising a closed drying air circuit (18), the apparatus comprising:

a drum (16, 106, 186) in communication with the closed drying air circuit;

a condenser (28, 118, 202) in communication with the closed drying air circuit and located downstream of the drum, the condenser comprising a cooled water inlet (60) that directs cooled water into heated air to remove moisture from the heated air, the condenser comprising a condenser water outlet (75) for egress of water from the condenser, the cooled water inlet of the condenser configured to receive water from a tap water source (38);

a thermoelectric apparatus (36, 126, 210) comprising a thermoelectric device (52, 142, 224), the thermoelectric apparatus comprising a cold side flow device (46, 136, 212) arranged between the cooled water inlet of the condenser and the tap water source, the cold side flow device configured to receive tap water from the tap water source and cool the tap water below a tap outlet temperature using the thermoelectric device before the tap water enters the cooled water inlet of the condenser; and a cooled water recirculation loop (92, 162) that directs at least some of the cooled water leaving the cold side flow device back to the cold side flow device to reintroduce the cooled water to the cold side flow device.

2. The apparatus according to claim 1, wherein a nozzle (64) in the condenser is configured to spray cooled water droplets into the heated air.

3. The apparatus according to claim 1, wherein the thermoelectric apparatus comprises a hot side flow device (40, 130) configured to receive tap water from the tap water source for transferring heat away from the cold side flow device.

4. The apparatus according to claim 3 further comprising a heated water recirculation loop (94, 164) that directs at least some of the heated water leaving the hot side flow device back to the hot side flow device to reintroduce the heated water to the hot side flow device.

5. The apparatus according to claim 1 further comprising a wash water circuit (20, 110, 190) in communication with the drum, the apparatus having a washing cycle within which wash water is provided to the drum and a drying cycle within which hot air is provided to the drum.

6. The apparatus according to claim 1 further comprising a cooled water storage (146, 226) between the cold side flow device and the cooled water inlet of the condenser.

7. The apparatus of claim 6 further comprising a cooled water recirculation loop (92, 162) that delivers at least some of the cooled water from the cooled water storage to the cold side flow device.

8. The apparatus according to claim 1, wherein the cold side flow device is configured to cool the tap water to no greater than about 9° C. using the thermoelectric device before the tap water enters the cooled water inlet of the condenser.

9. A method of removing water from heated air of the apparatus according to claim 1, the method comprising:

directing heated air from the drum to the condenser through the closed air drying circuit;

directing tap water from the tap water source to the thermoelectric apparatus;

cooling the tap water below the tap outlet temperature using the thermoelectric device before the tap water enters the cooled water inlet of the condenser; and directing at least some of the cooled water leaving the cold side flow device back to the cold side flow device to reintroduce the cooled water to the cold side flow device using a cooled water recirculation loop.

10. The method according to claim 9 further comprising a cooled water storage (144, 226) between the cold side flow device and the cooled water inlet of the condenser.

11. The method according to claim 10 further comprising delivering at least some of the cooled water from the cooled water storage to the cold side flow device using a cooled water recirculation loop.

12. The method according to claim 10 further comprising a memory and processing circuitry coupled to the memory, the memory including logic that, when executed by the processing circuitry, directs cooled water from the cold side flow device to the cooled water storage during a washing cycle and directs heated water to the drum using one or more of a valve and a pump.

13. The method of claim 12, wherein the memory including logic that, when executed by the processing circuitry, directs heated water from a hot side flow device (40, 130) to a heated water storage (146) during a drying cycle and directs cooled water to the condenser using one or more of a valve (156) and a pump (166).

* * * * *